US005698385A

United States Patent [19]

Ousaka et al.

[11] Patent Number: 5,698,385

[45] Date of Patent: Dec. 16, 1997

[54] SILVER HALIDE PHOTOSENSITIVE MATERIAL

[75] Inventors: Noriyuki Ousaka; Yasuhiro Okada, both of Sayama; Satoshi Kanetake; Kunio Ishigaki, both of Minamiashigara, all of Japan

[73] Assignees: Soken Chemical & Engineering Co., Ltd., Tokyo; Fuji Photo Film Co., Ltd., Minamiashigara, both of Japan

[21] Appl. No.: 446,868

[22] PCT Filed: Feb. 21, 1995

[86] PCT No.: PCT/JP95/00247

§ 371 Date: Jun. 5, 1995

§ 102(e) Date: Jun. 5, 1995

[87] PCT Pub. No.: WO95/22786

PCT Pub. Date: Aug. 24, 1995

[30] Foreign Application Priority Data

Feb. 21, 1994 [JP] Japan ..... 6-022394

[51] Int. Cl.[6] ..... G03C 1/32; G03C 1/95

[52] U.S. Cl. ..... 430/531; 430/536; 430/537; 430/627; 430/642; 430/950

[58] Field of Search ..... 430/950, 531, 430/536, 537, 627, 642

[56] References Cited

U.S. PATENT DOCUMENTS

| | | | |
|---|---|---|---|
| 4,956,257 | 9/1990 | Inoue | 430/264 |
| 5,072,830 | 12/1991 | Nielsen | 206/219 |
| 5,075,198 | 12/1991 | Katoh | 430/264 |
| 5,085,971 | 2/1992 | Katoh et al. | 430/264 |
| 5,093,222 | 3/1992 | Katoh | 430/264 |
| 5,139,921 | 8/1992 | Takagi et al. | 430/264 |
| 5,147,755 | 9/1992 | Katoh et al. | 430/264 |
| 5,196,293 | 3/1993 | Okamura et al. | 430/264 |
| 5,200,298 | 4/1993 | Takagi et al. | 430/264 |
| 5,208,139 | 5/1993 | Ishigaki | 430/523 |
| 5,229,262 | 7/1993 | Arai et al. | 430/583 |
| 5,236,807 | 8/1993 | Inoue et al. | 430/264 |
| 5,240,822 | 8/1993 | Tanaka et al. | 430/450 |
| 5,279,934 | 1/1994 | Smith et al. | 430/950 |
| 5,288,598 | 2/1994 | Sterman et al. | 430/950 |
| 5,300,411 | 4/1994 | Sterman et al. | 430/950 |
| 5,328,801 | 7/1994 | Yasuda et al. | 430/264 |
| 5,342,743 | 8/1994 | Goto et al. | 430/507 |
| 5,378,577 | 1/1995 | Smith et al. | 430/950 |
| 5,395,732 | 3/1995 | Katoh et al. | 430/264 |
| 5,556,738 | 9/1996 | Takamuki et al. | 430/526 |

FOREIGN PATENT DOCUMENTS

| | | | |
|---|---|---|---|
| 514675A1 | 11/1992 | European Pat. Off. | G03C 1/09 |
| 0693710 | 1/1996 | European Pat. Off. | G03C 1/95 |
| 61-048851 | 3/1986 | Japan . | |
| 61-259921 | 11/1986 | Japan . | |
| 63-236027 | 9/1988 | Japan | G03C 1/32 |
| 1112235 | 4/1989 | Japan | G03C 1/06 |
| 1118832 | 5/1989 | Japan | G03C 1/06 |
| 179939 | 7/1989 | Japan | G03C 5/26 |
| 1237538 | 9/1989 | Japan | G03C 1/06 |
| 212236 | 1/1990 | Japan | G03C 1/06 |
| 239042 | 2/1990 | Japan | G03C 1/76 |
| 239143 | 2/1990 | Japan | G03C 1/06 |
| 255349 | 2/1990 | Japan | G03C 1/06 |
| 2103536 | 4/1990 | Japan | G03C 5/29 |
| 297937 | 4/1990 | Japan | G03C 1/06 |
| 2124560 | 5/1990 | Japan | G03C 1/06 |
| 2-161425 | 6/1990 | Japan . | |
| 2287592 | 11/1990 | Japan | G09G 3/36 |
| 2294638 | 12/1990 | Japan | G03C 5/29 |
| 2301743 | 12/1990 | Japan | G03C 1/06 |
| 37928 | 1/1991 | Japan | G03C 1/10 |
| 3123346 | 5/1991 | Japan | G03C 1/76 |
| 3174143 | 7/1991 | Japan | G03C 1/06 |
| 416841 | 1/1992 | Japan | G03C 5/00 |
| 485533 | 3/1992 | Japan | G03C 5/29 |
| 4-104247 | 4/1992 | Japan | G03C 5/08 |
| 4214551 | 8/1992 | Japan | G03C 1/76 |
| 4278939 | 10/1992 | Japan | G03C 1/06 |
| 4-330430 | 11/1992 | Japan . | |
| 4330434 | 11/1992 | Japan | G03C 1/22 |
| 5-011382 | 1/1993 | Japan . | |
| 511389 | 1/1993 | Japan | G03C 1/09 |
| 5-257239 | 10/1993 | Japan . | |
| 6-202273 | 7/1994 | Japan | G03C 1/76 |
| WO9522786 | 8/1995 | WIPO | G03C 1/95 |

*Primary Examiner*—Mark F. Huff

*Attorney, Agent, or Firm*—Burns, Doane, Swecker & Mathis, LLP

[57] ABSTRACT

The silver halide photosensitive material of the invention comprises a support, at least one photosensitive silver halide emulsion layer provided on the support and a protective layer provided on the photosensitive silver halide emulsion layer. The protective layer contains agglomerate particles each of which is formed from plural primary particles having a particle diameter smaller than the thickness of the protective layer. For example, agglomerate particles having a mean particle diameter of 0.2 to 30 μm composed of primary particles having a mean particle diameter of 0.01 to 10 μm are contained in the protective layer having a thickness of 0.1 to 10 μm. By the use of such agglomerate particles as matting agent particles, pin-holes caused by sinking of the matting agent can be inhibited and the Bekk second can be made not longer than 2,000 seconds. Moreover, this matting agent has good affinity for gelatin and is almost free from powder-dropping.

5 Claims, No Drawings

SILVER HALIDE PHOTOSENSITIVE MATERIAL

TECHNICAL FIELD

The present invention relates to a silver halide photosensitive material having a silver halide emulsion layer and a protective layer disposed in this order on one surface of a support. More particularly, the invention relates to a silver halide photosensitive material containing a novel matting agent in the protective layer.

BACKGROUND ART

In conventional silver halide photosensitive materials, fine particles (matting agent) are incorporated into the protective layer to increase the surface roughness of the photosensitive materials, whereby the surfaces of the photosensitive materials are prevented from blocking when the photosensitive materials are contacted with each other or when they are contacted with processing apparatuses, and the antistatic properties or the vacuum contact properties in the contact exposure are improved.

As the matting agents, silica particles or plastic particles having particle diameters of about 1 to 10 μm have been conventionally used.

In the vacuum contact exposure of a photosensitive material containing such matting agents, however, a considerably long period of time is required to completely contact the photosensitive material. In order to shorten the time required for the contact, it is effective to make the particle diameters of the matting agent larger so as to further increase the surface roughness of the photosensitive material. However, the matting agent of large-sized particles tends to sink during the coating process, the contact exposure process and the developing process. When producing a sensitive material by simultaneously forming a silver halide emulsion layer and a protective layer with using a multi-layer simultaneous coating apparatus, or when contact-exposing and developing the sensitive material, the above-mentioned sinking of the matting agent reaches up to the silver halide emulsion layer present below the protective layer. As a result, the thickness of the silver halide emulsion layer is thinned at the matting agent-sinking portions, and this causes occurrence of pin-holes or lowering of the maximum density (D max) in the measurement of optical density of a solid portion. Especially in the photosensitive material having a thin silver halide emulsion layer, occurrence of pin-holes and lowering of D max are serious. Moreover, a problem of too rough surface of the photosensitive material also resides in the use of such a matting agent of large-sized particles as mentioned above.

Further, inoranic matting agents which have been broadly used as the matting agents, such as silica, are not so good in the affinity for gelatin which is used as a binder for forming a protective layer. Therefore, such inorganic matting agents sometimes drop off from the protective layer when the photosensitive material is handled. The inorganic matting agents thus dropped might hurt the skin of workers or damage the instruments such as a cylinder, because they have high hardness.

DISCLOSURE OF THE INVENTION

It is an object of the present invention to provide a photosensitive material in which pin-holes hardly take place at the image portion.

It is another object of the invention to provide a photosensitive material which can shorten a vacuumizing time in the contact exposure process.

It is a further object of the invention to provide a photosensitive material which is almost free from powder-dropping and rarely has a bad influence on the worker's skin or the like.

The silver halide photosensitive material of the present invention is a silver halide photosensitive material comprising a support, at least one phtosensitive silver halide emulsion layer disposed on the support and a protective layer disposed on the photosensitive silver halide emulsion layer, in which the protective layer contains agglomerate particles, each of said agglomerate particles being formed from plural primary particles having a mean particle diameter smaller than the thickness of the protective layer.

In the silver halide photosensitive material of the invention, the agglomerate particles formed from the primary particles having a mean particle diameter smaller than the thickness of the protective layer are contained in the protective layer as a matting agent. Hence, even if the thickness of the photosensitive silver halide emulsion layer is small, pin-holes hardly take place. Moreover, the vacuum contact exposure can be carried out for a short period of time.

Further, since the matting agent used in the invention is composed of the agglomerates of the primary particles having specific particle diameters, and these agglomerate particles have good affinity for a binder for forming the protective layer, such as gelatin. Therefore, powder-dropping or bad influence on the worker's skin caused by dropping of the matting agent hardly takes place.

BEST MODE FOR CARRYING OUT THE INVENTION

The silver halide photosensitive material according to the present invention will be described in detail hereinafter.

The silver halide photosensitive material of the invention comprises a support, at least one photosensitive silver halide emulsion layer provided on the support and a protective layer provided on the photosensitive silver halide emulsion layer.

In the silver halide photosensitive material of the invention, the protection layer contains a matting agent composed of agglomerate particles, each of which is formed from primary particles having a mean particle diameter smaller than the thickness of the protective layer.

The matting agent is formed from resin particles and/or inorganic particles having been surface-treated with a resin.

Examples of the resin particles include particles of acrylic resins, phenolic resins, styrene resins, polycarbonate resins, polyethylene resins, ABS resins, polypropylene resins, polyester resins and polyether resins. Of these, acrylic resin particles are particularly preferred in the invention.

Of the acrylic resin particles, preferred are (co)polymers of (meth)acrylates or copolymers of (meth)acrylates as major components and other monomers.

Examples of the (meth)acrylate type monomers include methyl (meth)acrylate, ethyl (meth)acrylate, propyl (meth) acrylate, butyl (meth)acrylate, 2-ethylhexyl (meth)acrylate, lauryl (meth)acrylate, stearyl (meth)acrylate, cyclohexyl (meth)acrylate, 2-hydroxyethyl (meth)acrylate, 2-propyl (meth)acrylate, chloro-2-hydroxyethyl (meth)acrylate, diethylene glycol mono(meth)acrylate, methoxyethyl (meth) acrylate, glycidyl (meth)acrylate, dicylopentanyl (meth) acrylate, dicylopentenyl (meth)acrylate and isoboronyl (meth)acrylate.

Examples of the other monomers copolymerizable with such (meth)acrylate type monomers include styrene type monomers, vinyl type monomers and unsaturated carboxylic acid monomers.

Particular examples of the styrene type monomers include alkylstyrenes, such as styrene, methylstyrene, dimethylstyrene, trimethylstyrene, ethylstyrene, diethylstyrene, triethylstyrene, propylstyrene, butylstyrene, hexylstyrene, heptylstyrene and octylstyrene; halogenated styrenes, such as fluorostyrene, chlorostyrene, bromostyrene, dibromostyrene, iodostyrene and chloromethylstyrene; other styrenes, such as nitrostyrene, acetylstyrene and methoxystyrene.

Particular examples of the vinyl type monomers include vinylpyridine, vinylpyrrolidone, vinylcarbazole, vinyl acetate and acrylonitrile; conjugated diene monomers, such as butadiene, isoprene and chloroprene; vinyl halides, such as vinyl chloride and vinyl bromide; and vinylidene halides, such as vinylidene chloride.

Particular examples of the unsaturated carboxylic acid monomers include addition polymerizable unsaturated aliphatic monocarboxylic acids, such as (meth)acrylic acid, α-ethyl(meth)acrylic acid, crotonic acid, α-methylcrotonic acid, α-ethylcrotonic acid, isocrotonic acid, tiglic acid and angelic acid; and addition polymerizable unsaturated aliphatic dicarboxylic acids, such as maleic acid, fumaric acid, itaconic acid, citraconic acid, mesaconic acid, glutaconic acid and hydromuconic acid.

In the above-mentioned copolymers of (meth)acrylates, two-functional or polyfunctional monomers may be copolymerized.

Examples of the two-functional or polyfunctional monomers include ethylene glycol di(meth)acrylate, triethylene glycol di(meth)acrylate, tetraethylene glycol di(meth) acrylate, trimethylolpropane tri(meth)acrylate, pentaerythritol tri(meth)acrylate, 1,1,1-trishydroxymethylethane triacrylate, 1,1,1-trishydroxymethylethane triacrylate, 1,1,1-trishydroxymethylpropane triacrylate and divinylbenzene.

Of the acrylic resins for forming the primary particles, preferably used are acrylic resins obtained by copolymerizing the (meth)acrylate type monomer in an amount of usually 1 to 100 parts by weight, preferably 50 to 100 parts by weight, the styrene type monomer in an amount of usually 99 to 0 part by weight, preferably 50 to 0 part by weight, the two-functional or polyfunctional monomer in an amount of usually 1 to 20 parts by weight, preferably 5 to 15 parts by weight, the vinyl type monomer in an amount of usually 0 to 50 parts by weight, and the unsaturated carboxylic acid monomer in an amount of usually 0 to 50 parts by weight.

The agglomerate particles contained in the protective layer can be prepared by polymerizing the above-mentioned monomers using or not using an agglomeration inhibitor in a seed polymerization process in which polymer particles obtained by emulsion polymerization, soap-free emulsion polymerization or precipitation polymerization are used as seed particles, and spray drying the resulting polymerization solution to remove the water content. The agglomerate particles thus obtained are classified using an air classification device or the like to make the agglomerate particle diameters uniform.

In more detail, polymer particles having particle diameters of about 0.4 μm are prepared by emulsion polymerization, and then they are spray dried to obtain agglomerate particles having particle diameters of about 10 to 15 μm. Thereafter, the agglomerate particles are crushed by a jet mill or a free crusher to obtain particles having diameters of about 0.5 to 15 μm. Then, the particles are classified by a classification device such as an air classification device to finally obtain agglomerate particles having a mean particle diameter of about 3 to 7 μm.

The state of agglomeration can be confirmed by an electron photomicrograph, and the particle diameter can be measured by particle size distribution.

In the above polymerization, a reaction initiator is used. Examples of the reaction initiators used herein include persulfates, such as potassium persulfate and ammonium persulfate; organic peroxides, such as benzoyl peroxide and lauryl peroxide; and azo compounds, such as azobisisobutyronitrile.

The agglomerate particles employable in the invention may be agglomerates of resin-coated inorganic particles obtained by surface-treating inorganic particles, such as particles of silicon dioxide, titanium dioxide, magnesium oxide, calcium carbonate, barium carbonate, barium sulfate and strontium sulfate, with a resin. The resins employable for the surface treatment of the inorganic particles are, for example, polyvinyl alcohol, gelatin, acrylic resin, styrene resin and urethane resin.

For surface-treating the inorganic particles, conventionally known surface treatments such as spray drying treatment, submerged microcapsulation treatment, submerged drying treatment, dispersion polymerization treatment and dry microcapsulation treatment can be adopted.

In the present invention, one kind of the above-mentioned agglomerate particles can be used, or different kinds of the agglomerate particles can be used in combination.

The agglomerate particles obtained as above have a mean particle diameter of usually 0.2 to 30 μm, preferably 1 to 10 μm, and the primary particles for forming these agglomerate particles have a mean particle diameter of usually 0.01 to 10 μm, preferably 0.5 to 3 μm.

The coefficient of variation of the agglomerate particles is preferably not more than 40%, more preferably not more than 20%. Determination of the coefficient of variation was carried out as follows. A dispersion of the particles was cast dried on a copper thin film, and the resulting Au-coated sample was photographed in 1,500 magnifications by a scanning type electron microscope (JSM-5400, produced by Japan Electron Optics Laboratory Co., Ltd.). The magnification correction was carried out by photographing the diffraction grating (500 lines/mm) at the same time. Using the obtained photograph, sectional area diameters of 200 or more particles were measured per one sample by means of Particle Size Analyzer TGZ-3 (produced by Karl Zeiss Co.), and a number-average particle diameter (particle diameter) was sought. Further, a standard deviation was calculated, and the coefficient of variation was then calculated by the following equation.

Coefficient of variation (%)=(Standard deviation)×100/(Particle diameter)

$$=\sqrt{\frac{\Sigma(\gamma-\gamma_i)^2 n_i}{\Sigma n_i}}\times\frac{100}{\bar{\gamma}}$$

In the above equation, $\bar{\gamma}$ is a number-average mean particle diameter. $n_i$ is the i-th particle, and $\gamma_i$ is a particle diameter of the i-th particle.

The protective layer for forming the silver halide photosensitive material of the invention has a thickness of usually 0.1 to 10 μm, preferably 0.5 to 5 μm, and the mean particle diameter of the primary particles is in the range of usually 1/100 to 1/1, preferably 1/50 to 1/1.2, as much as the thickness of the protective layer. The mean particle diameter of the agglomerate particles is in the range of usually 1/1 to 1/0.1, preferably 1/0.9 to 1/0.2, as much as the thickness of the protective layer.

In the protective layer, the agglomerate particles are dispersed in a binder. The binder for forming the protective layer is generally gelatin.

The agglomerate particles are contained in amounts of usually 0.1 to 5 parts by weight, preferably 0.2 to 2 parts by weight, based on 100 parts by weight of the binder such as gelatin.

The protective layer may further contain antistatic agent, ultraviolet light absorber, film hardener, etc. in addition to the above components.

In the protective layer, one agglomerate particle acts in a similar way to that of one particle of the conventional matting agent. However, the agglomerate particle used as the matting agent in the invention is an agglomerate of primary particles, and if a certain force is applied to the agglomerate particle during, for example, a coating procedure, the primary particles positioned on the peripheral part of the agglomerate particle can be released from the agglomerate particle. Therefore, in the case where the agglomerate particles are protruded from the protective layer surface in the coating procedure, if an external pressure is applied from the coating apparatus to the protruded portions, the primary particles for forming the agglomerate particles are partly crumbled, whereby the surface of the protective layer is more smoothed. The agglomerate particles are made of resin particles or inorganic particles having been surface-treated with resin, and are agglomerates of such primary particles as mentioned above. Hence, these agglomerate particles have good affinity for gelatin which forms the protective layer. That is, the component for forming the agglomerate particles and gelatin as a binder are both organic polymer compounds, and the affinity for each other is good. In addition, a number of fine protruded and depressed portions caused by the primary particles are formed on the surfaces of the agglomerate particles, and the binder permeates into these protruded and depressed portions to increase a physical bonding power between the binder and the agglomerate particles.

Accordingly, by the use of such agglomerate particles as the matting agent, the surface smoothness of the photosensitive material of the invention can be enhanced, and occurrence of pin-holes caused by sinking of the matting agent can be inhibited because the matting agent hardly sink. Further, since the agglomerate particles have high affinity for the binder, powder-dropping hardly takes place. Moreover, differently from the conventional sensitive materials using inorganic particles as they are as the matting agent, agglomerates of resin particles or resin-coated inorganic particles are used as the matting agent in the invention, and hence the matting agent does not hurt the worker's skin or the like.

In the present invention, the protective layer containing the matting agent is the topmost layer of the non-sensitive upper layer, but if the non-sensitive upper layer is made up of two or more layers, the protective layer containing the matting agent may be any one of those layers.

The non-sensitive upper layer used herein is either a non-sensitive hydrophilic colloidal layer present outside the silver halide emulsion layer which is positioned farthest from the support or a hydrophilic colloidal layer presents on the opposite side of the support to the silver halide emulsion layer. The non-sensitive upper layer is particularly preferably "a surface protective layer" of the silver halide emulsion layer.

The phtosensitive silver halide emulsion layer has a thickness of usually 0.1 to 5 μm, preferably 0.5 to 5 μm. Especially in the photosensitive material of the invention, the above-described agglomerate particles are used as the matting agent, so that sinking of the matting agent hardly takes place, and therefore occurrence of pin-holes is infrequent even when the silver halide emulsion layer is thin.

It is necessary that at least one photosensitive silver halide emulsion layer is provided on the support, while plural emulsion layers may be provided thereon.

The photosensitive silver halide emulsion layer is provided on the support.

Examples of the supports include flexible supports such as plastic films, paper and fabric; and rigid supports such as glasses, ceramics and metals.

Useful examples of the flexible supports include films of semi-synthetic or synthetic polymers, such as cellulose nitrate, cellulose acetate, cellulose acetate butyrate, polystyrene, polyvinyl chloride, polyethylene terephthalate, polyethylene naphthalate, syndiotactic polystyrene and polycarbonate; and paper coated or laminated with a baryta layer, an α-olefin polymer or the like.

The support may be colored with a dye or a pigment, or may be colored to black for the purpose of light-blocking.

The photosensitive silver halide emulsion layer may be directly provided on the support, or it is also possible to form an undercoat layer on the support and then provide the emulsion layer on the undercoat layer.

There is no specific limitation on various additives used in the sensitive material of the invention, and the additives described in relevant parts of the following documents can be favorably employed.

(1) Relevant parts to silver halide emulsions and processes for preparing the same: Japanese Patent Laid-Open Publication No. 97937/1990, p. 20, line 12 of the right and lower column—p. 21, line 14 of the left and lower column, Japanese Patent Laid-Open Publication No. 12236/1990, p. 7, line 19 of the right and upper column—p. 8, line 12 of the left and lower column, and Japanese Patent Laid-Open Publications No. 330430/1992 and No. 11389/1993;

(2) Relevant parts to spectral sensitizing dyes: Japanese Patent Laid-Open Publication No. 55349/1990, p. 7, line 8 of the left and upper column—p. 8, line 8 of the right and lower column, Japanese Patent Laid-Open Publication No. 39042/1990, p. 7, line 8 of the right and lower column—p. 13, line 5 of the right and lower column, Japanese Patent Laid-Open Publication No. 12236/1990, p. 8, line 13 of the left and lower column—line 4 of the light and lower column, Japanese Patent Laid-Open Publication No. 103536/1990, p. 16, line 3 of the right and lower column—p. 17, line 20 of the left and lower column, and Japanese patent Laid-Open Publications No. 112235/1989, No. 124560/1990, No. 7928/1991, No. 11389/1993 and No. 330434/1992;

(3) Relevant parts to hydrazine nucleating agents: Japanese Patent Laid-Open Publication No. 12236/1990, p. 2, line 19 of the right and upper column—p. 7, line 3 of the right and upper column, and the general formula (II) and the exemplified compounds II-1 to II-54 in Japanese Patent Laid-Open Publication No. 174143/1991, p. 20, line 1 of the right and lower column—p. 27, line 20 of the right and upper column;

(4) Relevant parts to nucleating promoters: the general formulas (II-m) to (II-p) and the exemplified compounds II-1 to II-22 in Japanese Patent Laid-Open Publication No. 103536/1990, p. 9, line 13 of the right and upper column—p. 16, line 10 of the left and upper column, and the compounds described in Japanese Patent Laid-Open Publication No. 179939/1989;

(5) Relevant parts to surface active agents: Japanese Patent Laid-Open Publication No. 12236/1990, p. 9, line 7 of the right and upper column—line 7 of the right and lower column;

(6) Relevant parts to compounds having acid group: Japanese Patent Laid-Open Publication No. 103536/1990, p.

18, line 6 of the right and lower column—p. 19, line 1 of the left and upper column, and Japanese Patent Laid-Open Publication No. 55349/1990, p. 8, line 13 of the right and lower column—p. 11, line 8 of the left and upper column;

(7) Relevant parts to anti-fogging agents: Japanese Patent Laid-Open Publication No. 103536/1990, p. 17, line 19 of the right and lower column—p. 18, line 4 of the right and upper column, p.18, lines 1–5 of right and lower column, and the thiosulfinic acid compounds described in Japanese Patent Laid-Open Publication No. 237538/1989;

(8) Relevant parts to polyhydroxybenzenes: Japanese Patent Laid-Open Publication No. 55349/1990, p. 11, line 9 of the left and upper column—line 17 of the right and lower column;

(9) Relevant parts to lubricants and plasticizers: Japanese Patent Laid-Open Publication No. 103536/1990, p. 19, line 6 of the right and upper column—p. 19, line 15 of the right and upper column, and Japanese Patent Laid-Open Publication No. 588/1989, p. 5, line 8 of the left and upper column—p. 12, line 16 of the right and upper column;

(10) Relevant parts to hardeners: Japanese Patent Laid-Open Publication No. 103536/1990, p. 18, lines 5–17 of the right and upper column;

(11) Relevant parts to dyes: Japanese Patent Laid-Open Publication No. 103536/1990, p. 17, lines 1–18 of the right and lower column, Japanese Patent Laid-Open Publication No. 39042/1990, p. 4, line 1 of the right and upper column—p. 6, line 5 of the right and upper column, and the solid dyes described in Japanese Patent Laid-Open Publication No. 294638/1990 and Japanese Patent Application No. 185773/1991;

(12) Relevant parts to tetrazolium compounds: Japanese Patent Laid-Open Publication No. 39143/1990, p. 4, line 8 of the left and lower column—p. 6, line 6 of the left and lower column, and Japanese Patent Laid-Open Publication No. 123346/1991, p. 3, line 19 of the right and upper column—p. 5, line 20 of the left and upper column;

(13) Relevant parts to black spots inhibitors: compounds described in U.S. Pat. No. 4,956,257 and Japanese Patent Laid-Open Publication No. 118832/1989;

(14) Relevant parts to redox compounds: the compounds represented by the general formula (I) (particularly, exemplified compounds 1 to 50) described in Japanese Patent Laid-Open Publication No. 301743/1990, the general formulas (R-1), (R-2) and (R-3) and the exemplified compounds 1 to 75 described in Japanese Patent Laid-Open Publication No. 174143/1991 pp. 3–20, and the compounds described in Japanese Patent Laid-Open Publications No. 257239/1993 and No. 278939/1992;

(15) Relevant parts to monomethine compounds: the compounds of the general formula (II) (particularly exemplified compounds II-1 to II-26) described in Japanese Patent Laid-Open Publication No. 287592/1990;

(16) Relevant parts to colloidal silica: the compounds described in Japanese Patent Laid-Open Publication No. 214551/1992, paragraph No. 0005; and

(17) Relevant parts to developing solutions and developing processes: Japanese Patent Laid-Open Publication No. 103536/1990, p. 19, line 16 of the right and upper column—p. 21, line 8 of the left and upper column, Japanese Patent Laid-Open Publication No. 55349/1990, p. 13, line 1 of the right and lower column—p. 16, line 10 of the left and upper column, and the processing solutions, powder agents and fixing processes described in Japanese Patent Laid-Open Publications No. 259921/1986, No. 85533/1992 and No. 16841/1992.

INDUSTRIAL APPLICABILITY

In the silver halide photosensitive material of the invention, agglomerate particles each of which is formed from plural primary particles having a particle diameter smaller than the thickness of the protective layer are used as the matting agent contained in the protective layer. Hence, pin-holes caused by sinking of the matting agent hardly take place, though it is very difficult to prevent occurrence of pin-holes by the use of conventional matting agents. Moreover, a photosensitive material having Bekk second of not longer than 2,000 seconds can be easily prepared.

Accordingly, the vacuumizing time for the vacuum contact exposure can be shortened.

Further, the agglomerate particles of the matting agent have good affinity for gelatin which is a binder of the protective layer. Hence, these agglomerate particles are almost free from powder-dropping and rarely have a bad influence on the worker's skin.

The silver halide photosensitive material of the invention can be used not only as an ordinarily used photosensitive material but also as a photosensitive material to light other than natural light, such as those generated by argon laser and infrared laser.

EXAMPLE

The present invention will be further described with reference to the following examples, but it should be construed that the invention is in no way limited to those examples.

Preparation Example 1

(Preparation of matting agent A)

Into a 1-liter four-necked flask equipped with a stirrer, a thermometer, a nitrogen gas feeding tube and a condenser were introduced 100 parts by weight of methyl methacrylate, 300 parts by weight of distilled water, 0.5 part by weight of sodium dodecylbenzenesulfonate, 0.5 part by weight of polyvinyl alcohol and 0.5 part by weight of sodium persulfate as a reaction initiator.

To the flask was then fed a nitrogen gas to replace air in the flask with the nitrogen gas, followed by conducting reaction at 60° C. for 3 hours with stirring in a stream of nitrogen.

After 3 hours, the reaction solution was cooled to 20° C. to obtain an emulsion containing fine particles. The mean particle diameter of the primary particles contained in the emulsion was 0.3 μm.

The emulsion was subjected to granulation in which the water content was removed using a spray dryer to obtain agglomerate particles. The agglomerate particles were crushed into agglomerate particles having particle diameters of 1 to 20 μm by means of a free crusher. These particles were classified by an air classification device to obtain agglomerate particles having a mean particle diameter of 6 μm.

Preparation Example 2

(Preparation of matting agent B)

The procedures of Preparation Example 1 were repeated except that 100 parts by weight of methyl methacrylate, 200 parts by weight of distilled water, 1 part by weight of polyvinyl alcohol and 1 part by weight of benzoyl peroxide (PBO) were introduced into the apparatus used in Preparation Example 1, they were subjected to initial emulsification by a homomixer, then the reaction was carried out at 60° C. for 3 hours in a stream of nitrogen with stirring, and the system was cooled to 20° C.

From the reaction solution obtained, fine particles having a primary particle diameter of 6 μm were obtained. These fine particles were not agglomerated.

Preparation Example 3

(Preparation of matting agent C)

The procedures of Preparation example 2 were repeated except that the amount of polyvinyl alcohol was varied to 2 parts by weight.

From the reaction solution obtained, fine particles having a primary particle diameter of 3 μm were obtained. These fine particles were not agglomerated.

Examples 1–3, Comparative Examples 1–8

Both surfaces of a biaxially oriented polyethylene terephthalate support having a thickness of 100 μm were coated with the following first undercoat layer and second undercoat layer in this order from the side near to the support, to form an undercoat layer.

(1) Formulation of the first undercoat layer

| | |
|---|---|
| Vinylidene chloride latex | 15 parts by weight |
| 2,4-Dichloro-6-hydroxy-1,3,5-triazine sodium salt | 0.2 part by weight |
| Colloidal silica (Snowtix ZL, available from Nissan Kagaku K.K.) | 1.1 parts by weight |

Then, polystyrene fine particles (mean particle diameter: 3 μm) were further added in an amount of 5 mg/m$^2$, and distilled water was also added. Moreover, 10 wt. % KOH was added to adjust the pH value to 6 and to make the total amount 100 parts by weight.

The coating solution obtained above was applied under the following conditions to form the first undercoat layer.

Temperature of coating solution: 10° C.

Film thickness on dry basis: 0.9 μm

Drying conditions: 180° C., 2 minutes (2) Formulation of the second undercoat layer

| | |
|---|---|
| Gelatin | 1 part by weight |
| Methyl cellulose | 0.05 part by weight |
| Compound-a | 0.02 part by weight |
| $C_{12}H_{25}O(CH_2CH_2O)_{10}H$ | 0.03 part by weight |
| Compound-b | $3.5 \times 10^{-3}$ part by weight |
| Acetic acid | 0.2 part by weight |

To the above components was added water to make the total amount 100 parts by weight.

This coating solution was applied under the following conditions to form a second undercoat layer.

Temperature of coating solution: 25° C.

Film thickness on dry basis: 0.1 g/m$^2$

Drying conditions: 170° C., 2 minutes

Compound-a

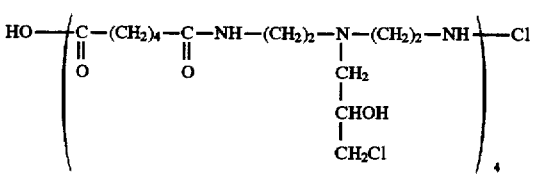

Compound-b

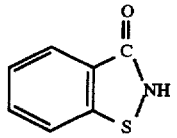

(Preparation of emulsion)

(Emulsion A)

To a gelatin aqueous solution kept at 40° C. were simultaneously added a silver sulfate aqueous solution and a sodium chloride aqueous solution containing $4\times10^{-5}$ mol of $(NH_4)_2Rh(H_2O)Cl_5$ per 1 mol of silver over a period of three and half minutes, and the electric potential in this procedure was controlled to 95 mV to obtain core grains having a mean grain size of 0.11 μm. Then, a silver sulfate aqueous solution and a sodium chloride aqueous solution containing $1.2\times10^{-4}$ mol of $(NH_4)_2Rh(H_2O)Cl_5$ per 1 mol of silver were simultaneously added over a period of 7 minutes, and the electric potential in this procedure was controlled to 95 mV. After the halogen aqueous solution was added as above, 5,6-cyclopentane-4-hydroxy-1,3,3a,7-tetrazaindene ($5\times10^{-3}$ mol per 1 mol of silver) was added to terminate physical ripening, to form silver chloride cubic grains having a mean grain size of 0.14 μm.

(Preparation of coated sample)

To the emulsion obtained above were added 24 mg/m$^2$ of 5,6-cyclopentane-4-hydroxy-1,3,3a,7-tetrazaindene, 770 mg/m$^2$ of ethyl acrylate latex (mean particle diameter: 0.05 μm), 3 mg/m$^2$ of a compound represented by the following formula and 126 mg/m$^2$ of 2-bis(vinylsulfonylacetamide) ethane as a hardener, and the mixture was applied to the aforementioned support in such an amount that the coating weight of silver would be 3.0 g/m$^2$. At this time, the coating weight of gelatin was 1.5 g/m$^2$.

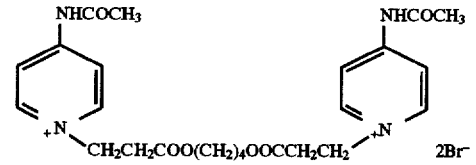

The thus coated layer were coated with 0.8 g/m$^2$ of gelatin, 8 mg/m$^2$ of lipoic acid, 6 mg/m$^2$ of $C_2H_5SO_2SNa$ and 230 mg/m$^2$ of ethyl acrylate latex (mean particle diameter: 0.05 μm) to form a lower protective layer, and this lower protective layer were then coated with 0.7 g/m$^2$ of gelatin and 75 g/m$^2$ of a compound represented by the following formula in the solid dispersion state to form an upper protective layer.

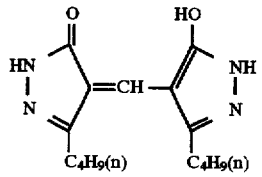

In the above procedure for forming the protective layer, the matting agent set forth in Table 1 was added, and 135 mg/m$^2$ of methanol silica (mean particle diameter: 0.02 μm), 25 mg/m$^2$ of sodium dodecylbenzenesulfonate as a coating aid, 20 mg/m$^2$ of a sulfonic acid ester sodium salt of polyoxyethylene nonylphenyl ether (polymerization degree: 5) and 3 mg/m$^2$ of N-perfluorooctanesulfonyl-N-propylglycine potassium salt were applied, to prepare a sample.

That is, the following particles were added in each of the examples:

Example 1: 30 mg/m$^2$ of agglomerate particles (matting agent) prepared in Preparation Example 1, Example 2: 10 mg/m$^2$ of agglomerate particles (matting agent) prepared in Preparation Example 1, Examples 3: 50 mg/m$^2$ of agglomerate particles (matting agent) prepared in Preparation Example 1, Comparative Example 1: 30 mg/m$^2$ of particles prepared in Preparation Example 2, Comparative Example 2: 10 mg/m$^2$ of particles prepared in Preparation Example 2, Comparative Example 3: 50 mg/m$^2$ of particles prepared in Preparation Example 2, Comparative Example 4: 30 mg/m$^2$ of particles prepared in Preparation Example 2, Comparative Example 5: 30 mg/m$^2$ of $(SiO_2)n$ particles (A-1) having a particle diameter of 2.5 μm, Comparative Example 6: 30 mg/m$^2$ of $(SiO_2)_n$ particles (A-2) having a particle diameter of 3.5 μm, Comparative Example 7: 30 mg/m$^2$ of $(SiO_2)_n$ particles (A-3) having a particle diameter of 6.5 μm, and Comparative Example 8: 30 mg/m$^2$ of particles (A-4) having a particle diameter of 2.5 μm which are represented by the following formula:

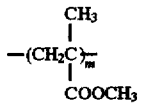

(A-4)

(particle diameter: 2.5 μm)

Compositions of the back layer and the back protective layer in the invention are described below. The back layer has a swelling index of 110%.

| | |
|---|---|
| Gelatin | 170 mg/m$^2$ |
| Sodium dodecylbenzenesulfonate | 32 mg/m$^2$ |
| Sodium dihexyl-α-sulfosuccinate | 35 mg/m$^2$ |
| $SnO_2$/Sb (9/1 by weight, mean particle diameter: 0.25 μm) | 318 mg/m$^2$ |
| (Back protective layer) | |
| Gelatin | 2.7 g |
| Polymethyl methacrylate fine particles (mean particle diameter: 7.4 μm) | 10 mg/m$^2$ |
| Sodium dihexyl-α-sulfosuccinate | 20 mg/m$^2$ |
| Sodium dodecylbenzenesulfonate | 67 mg/m$^2$ |
| Compound 5 represented by the following formula | 5 mg/m$^2$ |
| Dye A represented by the following formula | 190 mg/m$^2$ |
| Dye B represented by the following formula | 32 mg/m$^2$ |
| Dye C represented by the following formula | 59 mg/m$^2$ |
| Ethyl acrylate latex (mean particle diameter: 0.05 μm) | 260 mg/m$^2$ |
| 1,3-Divinylsulfonyl-2-propanol | 149 mg/m$^2$ |

Compound 5

$C_8H_{17}—SO_2—N(C_3H_7)—(CH_2CH_2O)_n—(CH_2)_4—SO_3Li$

Dye A

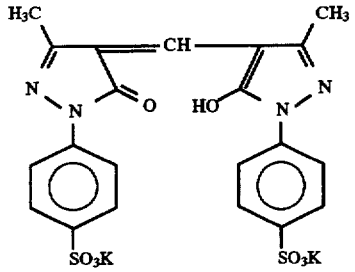

Dye B

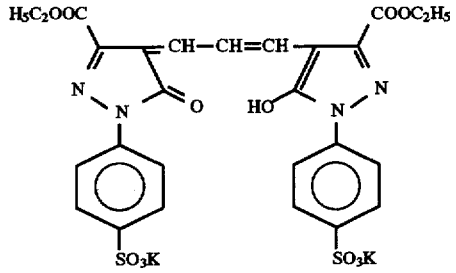

Dye C

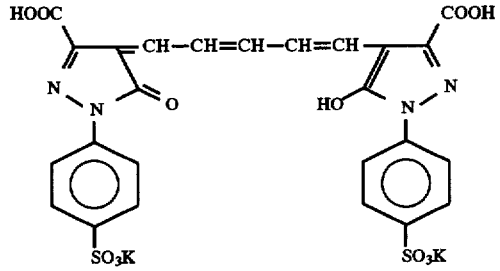

The sample thus obtained was allowed to stand for 10 days in an atmosphere of 25° C. and 60% RH and then evaluated on Bekk second, occurrence of pin-holes, vacuumizing time and resistance to damage by the methods described below.

Bekk second

The Bekk second was measured in accordance with "Testing Method for Smoothness of Paper and Paperboard by Bekk Tester of JIS-P-81191976".

Occurrence of pin-holes

The sensitive material prepared above was subjected to contact exposure together with an original having a halftone dot image by means of a contact dot-to-dot work printer FPA-740 (produced by Fuji Photo Film Co., Ltd.) and then developed at 38° C. for 20 seconds by means of an automatic developing machine FG-660F (produced by Fuji Photo Film Co., Ltd.). The exposure time of each sample during which 50% halftone dots of the halftone dot image of the original is printed as 50% halftone dots was determined, and the sample was uniformly exposed under those exposure conditions. After the development, occurrence of pin-holes was visually observed on a high-those luminance light table.

The evaluation on the occurrence of pin-holes was carried out by classifying the number of pin-holes into 5 levels of from 1 (the largest number of pin-holes) to 5 (the smallest number of pin-holes, i.e., best).

Vacuumizing time

Under the contact exposure printer, a flat original film (35 cm×45 cm) having a halftone dot image of 10% was brought into contact with a sample (40 cm×50 cm) in a degree of vacuum of 650 mmHg, and they were exposed and then developed, followed by measuring a vacuumizing time required for uniformizing the halftone image having been printed as 90% halftone dots. The shorter the vacuumizing time is, the better the vacuum contact properties are.

Evaluation on resistance to damage

A polyester support having a thickness of 100 μm was coated with 10 g/m$^2$ of gelatin to prepare a specimen (A).

The sample of each example was exposed all over the surface and developed to prepare a specimen (B) of solid.

After the specimens (A) and (B) were allowed to stand in an atmosphere of 25° C. and 30% RH, the gelatin surface of the specimen (A) was contacted with the matting agent surface of the specimen (B) and the specimens (A) and (B) were rubbed with each other by moving them back and forth 5 times under a load of 50 g.

The amount of the gelatin powder abraded by the matting agent was evaluated based on the 5 levels of from 1 (bad) to 5 (good) through the organoleptic test.

The results are set forth in Table 1.

TABLE 1

| | Matting agent | | | Occurrence of pin-holes | Vacuumizing time (sec.) | Damage resistance |
|---|---|---|---|---|---|---|
| | Kind | Coating weight ($mg/m^2$) | Beck second (sec.) | | | |
| Ex. 1 | Prep. Ex. 1 | 30 | 380 | 5 | 40 | 5 |
| Comp Ex. 1 | Prep. Ex. 2 | 30 | 500 | 1 | 45 | 5 |
| Ex. 2 | Prep. Ex. 1 | 10 | 700 | 5 | 50 | 5 |
| Comp Ex. 2 | Prep. Ex. 2 | 10 | 1000 | 2 | 60 | 5 |
| Ex. 3 | Prep. Ex. 1 | 50 | 200 | 5 | 35 | 5 |
| Comp Ex. 3 | Prep. Ex. 2 | 50 | 300 | 1 | 38 | 5 |
| Comp Ex. 4 | Prep. Ex. 3 | 30 | 1200 | 3 | 65 | 5 |
| Comp Ex. 5 | A-1 | 30 | 1500 | 5 | 75 | 2 |
| Comp Ex. 6 | A-2 | 30 | 700 | 5 | 50 | 1 |
| Comp Ex. 7 | A-3 | 30 | 400 | 4 | 40 | 1 |
| Comp Ex. 8 | A-4 | 30 | 5000 | 5 | 140 | 5 |

In the above table, A-1 to A-4 represent the following particles.

A-1: $(SiO_2)_n$ particles having a particle diameter of 2.5 μm

A-2: $(SiO_2)_n$ particles having a particle diameter of 3.5 μm

A-3: $(SiO_2)_n$ particles having a particle diameter of

A-4: particles having a particle diameter of 2.5 which are represented by the following formula:

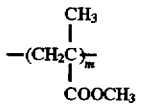

As is evident from the results set forth in Table 1, the samples of the invention are short in the Bekk second and the vacuumizing time and are excellent both in the occurrence of pin-holes and the resistance to damage.

Example 4, Comparative Examples 9–14

The same support as in Example 1 was used. On one surface of the support, two layers consisting of a conductive layer having the following formulation (3) and a back layer having the following formulation (4) were provided by mean of simultaneous superposition coating.

(3) Formulation of the conductive layer

| | |
|---|---|
| $SnO_2/Sb$ (9/1 by weight, mean particle diameter: 0.25 μm) | 300 $mg/m^2$ |
| Gelatin | 170 $mg/m^2$ |
| Compound-1 | 7 $mg/m^2$ |
| Sodium dodecylbenzenesulfonate | 10 $mg/m^2$ |
| Sodium dihexyl-α-sulfosuccinate | 40 $mg/m^2$ |
| Sodium polystyrenesulfonate | 9 $mg/m^2$ |

Compound-1

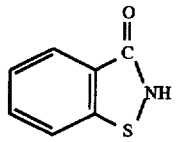

(4) Formulation of the back layer

| | |
|---|---|
| Gelatin | 2.9 $g/m^2$ |
| Compound-2 | 300 $mg/m^2$ |
| Compound-3 | 50 $mg/m^2$ |
| Compound-4 | 50 $mg/m^2$ |
| Compound-1 | 10 $mg/m^2$ |
| Sodium dodecylbenzenesulfonate | 70 $mg/m^2$ |
| Sodium dibenzyl-α-sulfosuccinate | 15 $mg/m^2$ |
| 1,1-Bis(vinylsulfonyl)methane | 150 $mg/m^2$ |
| Ethyl acrylate latex (mean particle diameter: 0.05 μm) | 500 $mg/m^2$ |
| Lithium perfluorooctanesulfonate | 10 $mg/m^2$ |
| Polymethyl methacrylate fine particles (mean particle diameter: 7.5 μm) | 10 $mg/m^2$ |

Compound-1

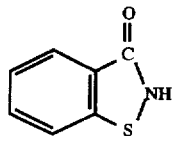

Compound-2

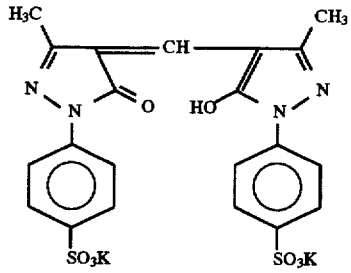

Compound-3

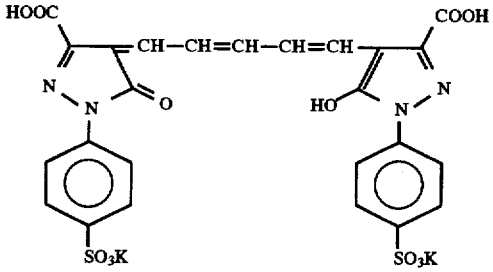

Compound-4

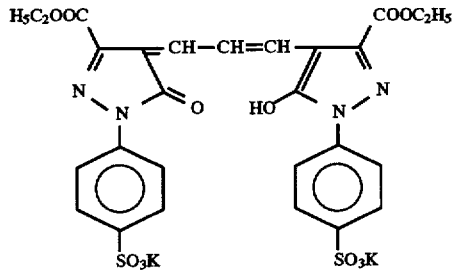

On the opposite side surface, a silver halide emulsion layer-1 of the following formulation (5), a silver halide emulsion layer-2 of the following formulation (6), a protective layer-2 of the following formulation (7) and a protective layer-3 of the following formulation (8) were provided in this order.

(5) Formulation of the silver halide emulsion layer-1

Solution I water: 300 ml, gelatin: 9 g

Solution II $AgNO_3$: 100 g, water: 400 ml

Solution III

NaCl: 37 g, $(NH_4)_3RhCl_6$: 1.1 mg, water: 400 ml

To the solution I kept at 45° C. were simultaneously added the solution II and the solution III at constant rates.

From the resulting emulsion, soluble salts were removed by a conventional method well known to those skilled in the art. To the emulsion was then added gelatin and was further added 6-methyl-4-hydroxy-1,3,3a,7-tetrazaindene as a stabilizer. This emulsion was a monodispersed emulsion having a mean grain size of 0.20 μm, and the amount of gelatin contained in 1 kg of the emulsion was 60 g.

To the emulsion thus obtained were added the following compounds.

Compound-1

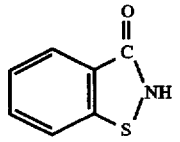

Compound-5

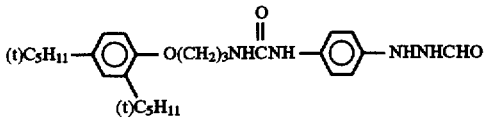

Compound-6

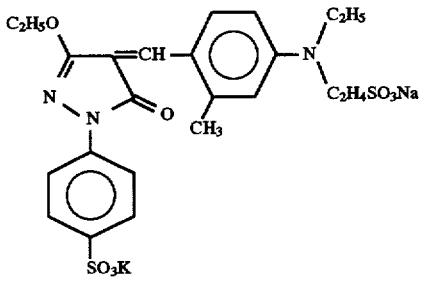

Compound-7

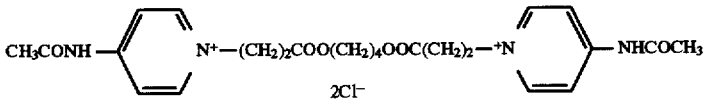

| | |
|---|---|
| Compound-5 | $6 \times 10^{-3}$ mol/Ag-1 mol |
| Compound-6 | 60 mg/m$^2$ |
| Compound-7 | 9 mg/m$^2$ |
| Compound-1 | 10 mg/m$^2$ |
| Sodium polystyrenesulfonate | 40 mg/m$^2$ |
| N-Oleoyl-N-methyltaurine sodium salt | 50 mg/m$^2$ |
| 1,1'-Bis(vinylsulfonyl) methane | 70 mg/m$^2$ |
| 1-Phenyl-5-mercaptotetrazole | 3 mg/m$^2$ |
| Ethyl acrylate latex (mean particle diameter: 0.05 μm) | 0.46 g/m$^2$ |

The resulting coating solution was applied in such an amount that the coating weight of silver comes to 1.3 g/m$^2$.

(6) Formulation of the silver halide emulsion layer-1

Solution I water: 300 ml, gelatin: 9 g

Solution II $AgNO_3$: 100 g, water: 400 ml

Solution III

NaCl: 37 g, $(NH_4)_3RhCl_6$: 2.2 mg, water: 400 ml

To the solution I were simultaneously added the solution II and the solution III in the same manner as for the emulsion of the formulation (5), to prepare an emulsion.

This emulsion was a monodispersed emulsion having a mean grain size of 0.20 μm.

To the emulsion thus obtained were added the following compounds.

| | |
|---|---|
| Compound-5 | $5 \times 10^{-3}$ mol/Ag-1 mol |
| Compound-6 | 60 mg/m$^2$ |
| Compound-7 | 9 mg/m$^2$ |
| Compound-1 | 10 mg/m$^2$ |

-continued

| | |
|---|---|
| Sodium polystyrenesulfonate | 50 mg/m² |
| N-Oleoyl-N-methyltaurine sodium salt | 40 mg/m² |
| 1,1'-Bis(vinylsulfonyl)methane | 80 mg/m² |
| 1-Phenyl-5-mercaptotetrazole | 3 mg/m² |
| Ethyl acrylate latex (mean particle diameter: 0.05 μm) | 0.40 g/m² |

The resulting coating solution was applied in such an amount that the coating weight of silver comes to 1.3 g/m².

Compound-1

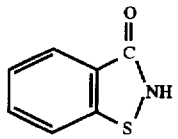

Compound-5

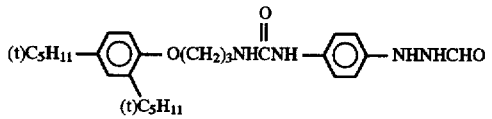

Compound-6

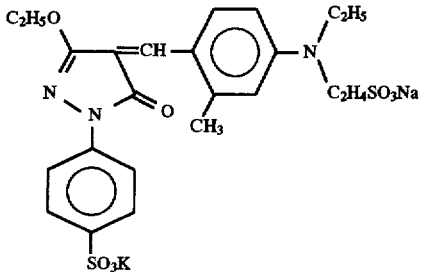

Compound-7

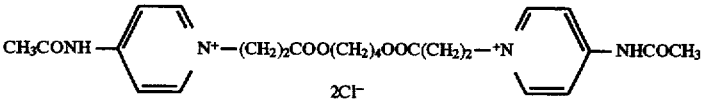

(7) Formulation of the protective layer-2

| | |
|---|---|
| Gelatin | 1.0 g/m² |
| Lipoic acid | 5 mg/m² |
| Sodium dodecylbenzenesulfonate | 5 mg/m² |
| Compound-8 | 20 mg/m² |
| Sodium polystyrenesulfonate | 10 mg/m² |
| Compound-9 | 20 mg/m² |
| Ethyl acrylate latex (mean particle diameter: 0.05 μm) | 200 mg/m² |

Compound-8

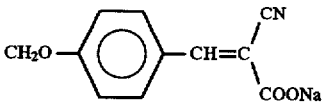

Compound-9

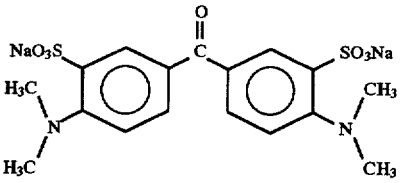

(8) Formulation of the protective layer-3

| | |
|---|---|
| Gelatin | 1.0 g/m² |
| Matting agent | (set forth in Table 2) |
| Sodium dodecylbenzenesulfonate | 20 mg/m² |
| Potassium perfluorooctanesulfonate | 10 mg/m² |
| N-Perfluorooctanesufonyl-N-propylglycine potassium salt | 3 mg/m² |
| Sodium polystyrenesulfonate | 2 mg/m² |
| Sulfuric acid ester sodium salt of polyoxyethylene nonylphenyl ether (polymerization degree: 5) | 20 mg/m² |

That is, the following particles were added in each of the examples:

Example 4: 30 mg/m² of agglomerate particles (matting agent) prepared in Preparation Example 1, Comparative Example 9: 30 mg/m² of particles prepared in Preparation Example 2, Comparative Example 10: 30 mg/m² of particles prepared in Preparation Example 3, Comparative Example 11: 30 mg/m² of the aforementioned particles (A-1), Comparative Example 12: 30 mg/m² of the aforementioned particles (A-2), Comparative Example 13: 30 mg/m² of the aforementioned particles (A-3), and Comparative Example 14: 30 mg/m² of the aforementioned particles (A-5).

(Preparation of the emulsified dispersion of hydrazine derivative)

Solution I

| | |
|---|---|
| Compound-5 | 3.0 g |
| Compound-10 | 1.5 g |
| Poly-(N-tert-butylacrylamide) | 6.0 g |
| Ethyl acetate | 30 ml |
| Sodium dodecylbenzenesulfonate (72% methanol solution) | 0.12 g |
| Water | 0.12 ml |

The above components were heated to 65° C. to homogeneously dissolve them so as to give a solution I.

Compound-5

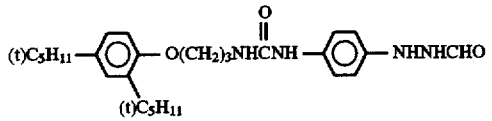

Compound-10

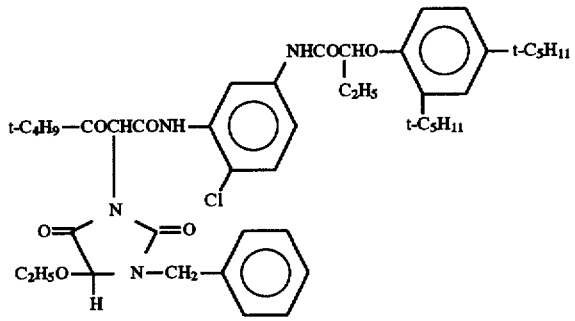

Solution II

| | |
|---|---|
| Gelatin | 12 g |
| Compound-1 | 0.02 g |
| Water | 108 ml |

The above components were heated to 65° C. to homogeneously dissolve them so as to give a solution II.

The solution I and the solution II were mixed with each other, and the resulting mixture was subjected to high-speed agitation by a homogenizer (produced by Nippon Seiki Seisakusho K.K.) to obtain a fine particle emulsified dispersion.

From this emulsion, ethyl acetate was removed by means of heating vacuum distillation. Then, water was added to make the total amount 250 g. The ethyl acetate residue was 0.2%.

The sample thus obtained was evaluated in the same manner as described in Example 1.

As is evident from the results set forth in Table 2, the sensitive materials of the invention are excellent in any properties of Bekk second, occurrence of pin-holes, vacuum contact properties and resistance to damage.

TABLE 2

| | Matting agent | | | Occurrence of pin-holes | Vacuumizing time (sec.) | Damage resistance |
|---|---|---|---|---|---|---|
| | Kind | Coating weight (mg/m²) | Beck second (sec.) | | | |
| Ex. 4 | Prep. Ex. 1 | 30 | 450 | 5 | 42 | 5 |
| Comp. Ex. 9 | Prep. Ex. 2 | 30 | 550 | 1 | 45 | 5 |
| Comp. Ex. 10 | Prep. Ex. 3 | 30 | 1300 | 3 | 63 | 5 |
| Comp. Ex. 11 | A-1 | 30 | 1500 | 5 | 68 | 2 |
| Comp. Ex. 12 | A-2 | 30 | 750 | 5 | 52 | 1 |
| Comp. Ex. 13 | A-3 | 30 | 450 | 4 | 40 | 1 |
| Comp. Ex. 14 | A-4 | 30 | 5000 | 5 | 140 | 5 |

In the above table, the matting agents A-1 to A-4 are the same as those described before.

Example 5

One surface of a biaxially oriented polyethylene terephthalate support (thickness 100 μm) having an undercoat layer on each side was coated with a conductive layer having the following composition, and the surface of this conductive layer was coated with a back layer having the following composition.

(Conductive layer)

| | |
|---|---|
| $SnO_2$/Sb (9/1 by weight, mean particle diameter: 0.25 μm) | 200 mg/m² |
| Gelatin ($Ca^{++}$ content: 3,000 ppm) | 77 mg/m² |
| Compound-(1) | 7 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |

The conductive layer of the above composition had a surface resistance of $3.0\times10^9\Omega$ under the conditions of 25° C. and 20% RH.

Compound-(1)

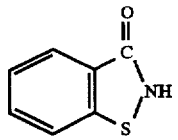

(Back layer)

| | |
|---|---|
| Gelatin ($Ca^{++}$ content: 30 ppm) | 2.82 g/m² |
| Compound-(1) | 3 mg/m² |
| Polymethyl methacrylate fine particles (mean particle diameter: 3.4 μm) | 50 mg/m² |
| Compound-(2) | 40 mg/m² |
| Compound-(3) | 40 mg/m² |
| Compound-(4) | 80 mg/m² |
| Sodium dodecylbenzenesulfonate | 75 mg/m² |
| Sodium dihexyl-α-sulfosuccinate | 20 mg/m² |
| Compound-(5) | 5 mg/m² |
| N-Perfluorooctanesulfonyl-N-propylglycine potassium salt | 7 mg/m² |
| Sodium sulfate | 50 mg/m² |
| Sodium acetate | 85 mg/m² |
| 1,2-Bis(vinylsulfonylacetamide)ethane | 150 mg/m² |

Compound-(1)

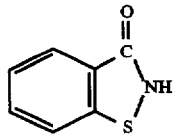

Compound-(2)

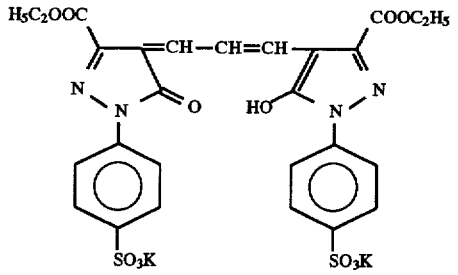

Compound-(3)

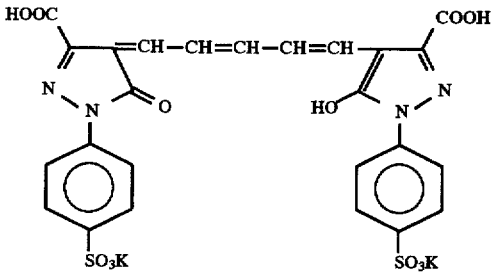

Compound-(4)

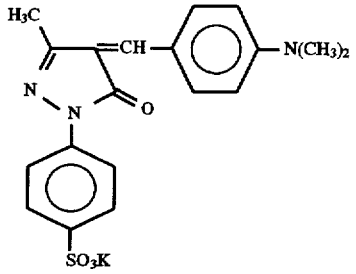

Compound-(5)

$C_8F_{17}SO_3Li$

On the other side surface of the support, an emulsion layer, a lower protective layer and an upper protective layer of the following compositions were provided by means of simultaneous superposition coating.

Solution I

| | |
|---|---|
| Water | 1,000 ml |
| Gelatin | 20 g |
| Sodium chloride | 20 g |
| 1,3-Dimethylimidazolidine-2-thione | 20 g |
| Sodium benzenesulfonate | 6 mg |

Solution II

| | |
|---|---|
| Water | 400 ml |
| Silver nitrate | 100 g |

Solution III

| | |
|---|---|
| Water | 400 ml |
| Sodium chloride | 30.5 g |
| Potassium bromide | 14 g |
| Potassium hexachloroiridate (III) (0.001% aqueous solution) | 15 ml |
| Ammonium hexabromorhodate (III) (0.001% aqueous solution) | 1.5 ml |

To the solution I kept at 38° C. and a pH value of 4.5 were simultaneously added the solution II and the solution III over a period of 10 minutes with stirring, to form grains having a grain size of 0.16 μm. To the mixture were added the following solutions IV and V over a period of 10 minutes. To the mixture was further added 0.15 g of potassium iodide to complete formation of grains.

Solution IV

| | |
|---|---|
| Water | 400 ml |
| Silver nitrate | 100 g |

Solution V

| | |
|---|---|
| Water | 400 ml |
| Sodium chloride | 30.5 g |
| Potassium bromide | 14 g |
| $K_4Fe(CN)_6$ | $1 \times 10^{-5}$ mol/mol-Ag |

Then, the mixture was washed with water by means of flocculation according to the usual way, following by adding 40 g of gelatin.

The resulting emulsion was adjusted to a pH value of 5.3 and a pAg value of 7.5. To the emulsion were then added 5.2 mg of sodium thiosulfate, 10.0 mg of gold chloride acid and 2.0 mg of N,N-dimethylselenourea and were further added 8 mg of sodium benzenesulfonate and 2.0 mg of sodium benzenesulfinate. The resulting mixture was subjected to chemical sensitization in such a manner that the emulsion comes to have the optimum sensitivity at 55° C. Thus, a silver iodochloride cubic grain emulsion containing 80% by mol of silver chloride and having a mean grain size of 0.20 μm was prepared.

Subsequently, to the emulsion was added a sensitizing dye (1) represented by the following formula in a concentration of $5\times10^{-4}$ mol/mol-Ag to perform orthochromatic sensitization. Then, hydroquinone and 1-phenyl-5-mercaptotetrazole were added as anti-fogging agents in amounts of 2.5 g and 50 mg, respectively, per 1 mol of Ag. Further, colloidal silica (Snowtex C, available from Nissan Kagaku K.K., mean particle diameter: 0.015 μm) was added in an amount of 30% by weight based on the amount of gelatin. Furthermore, polyethyl acrylate latex (mean particle diameter: 80 nm) was added as a plasticizer in an amount of 40% by weight based on the amount of gelatin, and 1,1'-bis (vinylsulfonyl)methane was added as a hardener in an amount of 100 mg/m$^2$.

The resulting coating solution was applied onto the support in such an amount that the coating weights of Ag and gelatin would be 3.3 mg/m$^2$ and 1.5 mg/m$^2$, respectively.

Sensitizing dye (1)

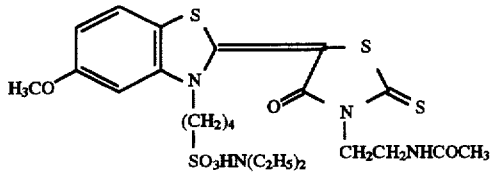

(Formulation of the lower protective layer)

| | |
|---|---|
| Gelatin | 0.5 g/m² |
| Sodium benzenesulfonate | 4 mg/m² |
| 1,5-Dihydroxy-2-benzaldoxime | 25 mg/m² |
| Polyethyl acrylate latex (mean particle diameter: 80 nm) | 125 mg/m² |

(Formulation of the upper protective layer)

| | |
|---|---|
| Gelatin | 0.25 g/m² |
| Matting agent of Preparation Example 1 (coefficient of variation: 20%) | 40 mg/m² |
| Compound-(6) (gelatin dispersion of lubricant) | 30 mg/m² |
| Colloidal silica (Snowtex C, available from Nissan Kagaku K.K.) | 30 mg/m² |
| Compound-(7) | 5 mg/m² |
| Sodium dodecylbenzenesulfonate | 22 mg/m² |

This sample had a coefficient of dynamic friction of 0.22±0.03 (25° C. 60% RH, sapphire needle diameter: 1 mm, load: 100 g, speed: 60 cm/min).

Compound-(6)

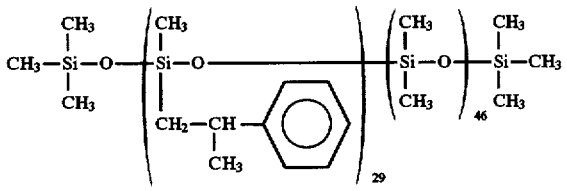

Compound-(7)

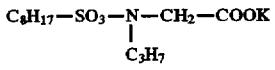

The sample obtained was exposed to xenon flash light (light emission time: $10^{-6}$ sec) through an interference filter having a peak at 488 nm and a continuous density wedge, then developed using an automatic developing machine FG-680AS (produced by Fuji Photo Film Co., Ltd.), and evaluated in the same manner as described in Example 1.

As the developing solution and the fixing solution, SR-D2 and SR-F1 (available from Fuji Photo Film Co., Ltd.) were used, respectively. The development was carried out at 38° C. for 11 seconds.

As a result, a sensitive material for argon laser scanner which was free from occurrence of pin-holes (starry night) and had a high contrast (γ value: 7) and a high D max was obtained.

Example 6

One surface of a biaxially oriented polyethylene terephthalate support (thickness 100 μm) having an undercoat layer on each side was coated with a conductive layer, a back layer and a back protective layer of the following compositions.

(Conductive layer)

| | |
|---|---|
| $SnO_2$/Sb (9/1 by weight, mean particle diameter: 0.25 μm) | 200 mg/m² |
| Gelatin ($Ca^{++}$ content: 3,000 ppm) | 77 mg/m² |
| Compound-(1) | 7 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |

Compound-(1)

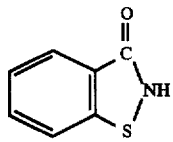

(Back layer)

| | |
|---|---|
| Gelatin ($Ca^{++}$ content: 30 ppm) | 2.0 g/m² |
| Compound-(1) | 3 mg/m² |
| Dye-a | 35 mg/m² |
| Dye-b | 95 mg/m² |
| Dye-c | 70 mg/m² |
| Sodium dihexyl-α-sulfosuccinate | 25 mg/m² |
| Sodium dodecylbenzenesulfonate | 35 mg/m² |
| Acetic acid | 10 mg/m² |
| 1,3-Divinylsulfonyl-2-propanol | 130 mg/m² |

Compound-(1)

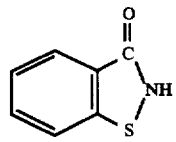

Dye-a

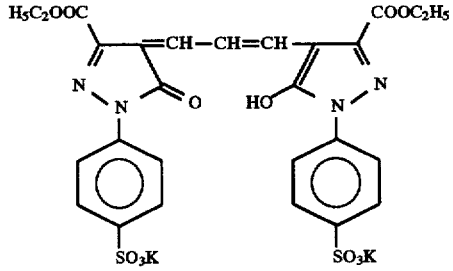

Dye-b

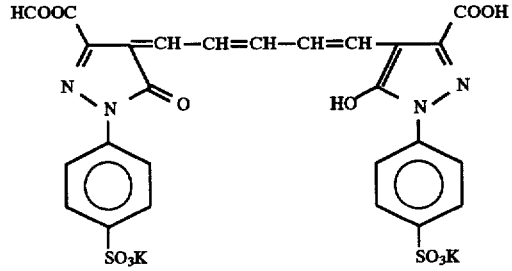

Dye-c

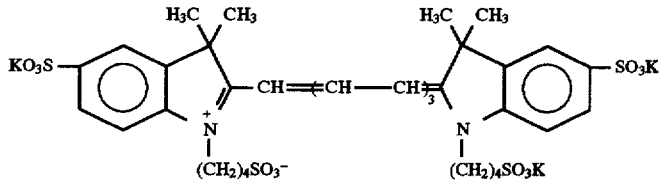

(Back protective layer)

| | |
|---|---|
| Gelatin | 0.8 mg/m$^2$ |
| Compound-(1) | 1 mg/m$^2$ |
| Polymethyl methacrylate fine particles (mean particle diameter: 3.4 μm) | 35 mg/m$^2$ |
| Sodium dihexyl-α-sulfosuccinate | 7 mg/m$^2$ |
| Sodium dodecylbenzenesulfonate | 10 mg/m$^2$ |
| Compound-(2) | 2 mg/m$^2$ |
| Sodium acetate | 30 mg/m$^2$ |

Compound-(1)

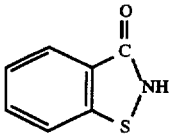

Compound-(2)

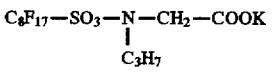

On the other side surface of the support, an emulsion layer and a protective layer of the following compositions were provided by means of simultaneous superposition coating.

(Emulsion layer)

A halogen salt aqueous solution containing 0.13 mol of a silver nitrate aqueous solution, 0.04 mol of potassium bromide, 0.09 mol of sodium chloride and ammonium hexachlororhodate (III) was added to a gelatin solution containing sodium chloride and 1,8-dihydroxy-3,6-dithiooctane with stirring at 45° C. for 12 minutes by a double jet method, to perform nuclear formation, thereby forming silver chlorobromide grains having a mean grain size of 0.15 μm and a silver chloride content of 70% by mol.

Then, to the reaction solution was added a halogen salt solution containing 0.87 mol of a silver nitrate aqueous solution, 0.26 mol of potassium bromide, 0.65 mol of sodium chloride and potassium hexachloroiridate (III) over a period of 20 minutes by a double jet method.

Thereafter, the mixture was washed with water by means of flocculation according to the usual way. To the resulting emulsion was added gelatin and the resultant mixture was adjusted in the pH value and the pAg value to 6.5 and 7.5, respectively. To the emulsion were further added 5 mg of sodium thiosulfate and 8 mg of gold chloride acid, per 1 mol of silver, and the mixture was heated at 60° C. for 75 minutes to perform chemical sensitization. Then, 150 mg of 1,3,3a7-tetrazaindene was added as a stabilizer.

The resulting grains contained Rh in an amount of $1.0\times10^{-7}$ mol per 1 mol of silver and Ir in an amount of $6.0\times10^{-7}$ mol per 1 mol of silver.

The grains were silver chlorobromide cubic grains having a mean grain size of 0.28 μm (coefficient of variation: 10%) and a silver chloride content of 70% by mol.

To 1 kg of the emulsion was added 60 ml of a 0.05% solution of an infrared sensitizing dye (3) and were further added 70 ml of a 0.5% methanol solution of disodium 4,4'-bis-(4,6-dinaphthoxypyrimidine-2-ylamino)-stilbenedisulfonate as a supersensitizing dye and 90 ml of a 0.5% methanol solution of 2,5-dimethyl-3-allyl-benzothiazole iodide salt as a stabilizer.

Then, 100 mg/m$^2$ of hydroquinone was added. Further, polyethyl acrylate latex (mean particle diameter: 80 nm) was added as a plasticizer in an amount of 25% by weight based on the amount of gelatin, and 1,1'-bis(vinylsulfonyl)methane was added as a hardener in an amount of 78 mg/m$^2$. The resulting coating solution was applied onto the support in such an amount that the coating weights of Ag and gelatin would be 3.7 mg/m$^2$ and 1.8 mg/m$^2$, respectively.

Infrared sensitizing dye (3)

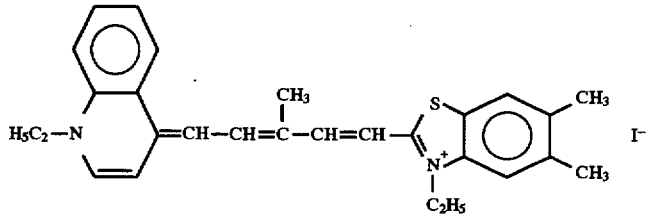

(Protective layer)

| | |
|---|---|
| Gelatin | 0.7 g/m$^2$ |
| Compound-(3) | 2 mg/m$^2$ |
| Matting agent of Preparation Example 1 (coefficient of variation: 10%) | 40 mg/m$^2$ |
| Compound-(4) | 30 mg/m$^2$ |
| Dye-c | 7 mg/m$^2$ |
| Sodium dodecylbenzenesulfonate | 30 mg/m$^2$ |
| Colloidal silica (Snowtex C, available from Nissan Kagaku K.K.) | 10 mg/m$^2$ |
| Compound-(5) | 2 mg/m$^2$ |
| Hydroquinone | 45 mg/m$^2$ |
| 1,5-Dihydroxy-2-benzaldoxime | 8 mg/m$^2$ |
| Sodium benzenethiosulfonate | 4 mg/m$^2$ |

Compound-(3)

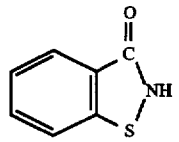

Compound-(4)

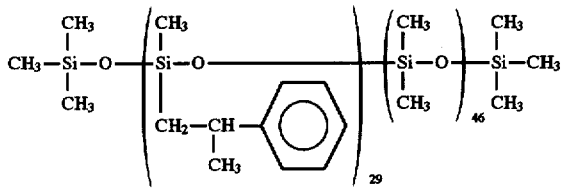

Compound-(5)

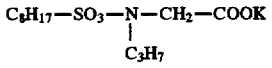

Dye-c

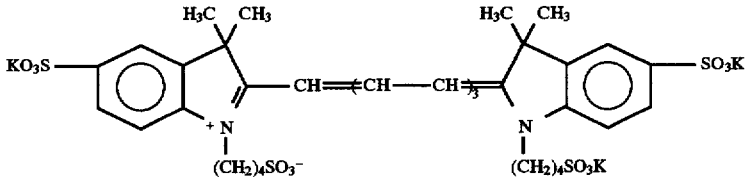

The sample obtained was evaluated in the same manner as described in Example 5 except that the interference filter was replaced with a filter having a peak at 80 nm.

As the developing solution and the fixing solution, SR-D2 and SR-F1 (available from Fuji Photo Film Co., Ltd.) were used, respectively. The development was carried out at 38° C. for 20 seconds.

As a result, a sensitive material for semiconductor laser scanner which was free from occurrence of pin-holes (starry night) and had a high contrast (γ value: 8) and a high D max was obtained.

Example 7

In place of the sensitizing dye in the emulsion of Example 5, a sensitizing dye (2) was used in an amount of 100 mg per 1 mol of Ag, and disodium 4,4'-bis(4,6-dinaphthoxy-pyrimidine-2-ylamino)-stilbenedisulfonate was added as a supersensitizing dye and a stabilizer in an amount of 300 mg per 1 mol of Ag, so as to perform panchromatic sensitization.

Further, the anti-fogging agent, the colloidal silica, the plasticizer and the hardener used in Example 5 were added to prepare a coating solution for forming an emulsion layer.

A sample was prepared in the same manner as described in Example 5 except that the coating solution was applied in such an amount that the coating weights of Ag and gelatin would be 3.4 mg/m$^2$ and 1.4 mg/m$^2$, respectively.

The sample obtained was evaluated in the same manner as described in Example 5 except that the interference filter was replaced with a filter having a peak at 633 nm.

As a result, a sensitive material for helium neon laser scanner which was free from occurrence of pine-holes (starry night) and had a high contrast (γ value: 7) and a high D max was obtained.

Sensitizing dye (3)

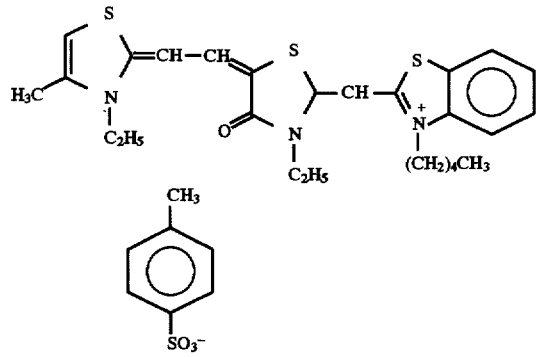

What is claimed is:

1. A silver halide photosensitive material comprising a support, at least one photosensitive silver halide emulsion layer disposed on the support and a protective layer disposed on the photosensitive silver halide sensitive emulsion layer, said protective layer containing agglomerate particles each of which is formed from plural primary particles having a mean particle diameter smaller than the thickness of the protective layer, wherein said agglomerate particles each consists essentially of primary particles which are the same in material as each other.

2. The silver halide photosensitive material as claimed in claim 1, wherein the thickness of the protective layer is in the range of 0.1 to 10 μm, the mean particle diameter of the primary particles is in the range of 0.01 to 10 μm, and the mean particle diameter of the agglomerate particles is in the range of 0.2 to 30 μm.

3. The silver halide photosensitive material as claimed in claim 1 or claim 2, wherein the primary particles are resin particles or inorganic particles surface-treated with a resin.

4. The silver halide photosensitive material as claimed in claim 3, wherein the primary particles are acrylic resin particles.

5. The silver halide photosensitive material as claimed in claim 1, wherein the agglomerate particles are prepared by polymerizing monomers to obtain a polymerization liquid containing fine particles as said primary particles, spray drying the polymerization liquid to obtain dried agglomerates formed from the fine particles, and classifying the agglomerates into said agglomerate particles by particle diameter.

* * * * *